United States Patent [19]

Wirz et al.

[11] 4,437,407

[45] Mar. 20, 1984

[54] DEVICE FOR CONTROLLING THE CLAMPING OF PRINTING PLATES IN CORRECT REGISTER ON THE PLATE CYLINDER OF AN OFFSET PRINTING MACHINE

[75] Inventors: Burkhardt Wirz; Alfred Preuss, both of Munich, Fed. Rep. of Germany

[73] Assignee: Grapho Metronic Mess- und Regeltechnik GmbH & Co. KG, Munich, Fed. Rep. of Germany

[21] Appl. No.: 423,236

[22] Filed: Sep. 24, 1982

[30] Foreign Application Priority Data

Sep. 30, 1981 [DE] Fed. Rep. of Germany ..... 3138865

[51] Int. Cl.[3] ..... B41F 1/30

[52] U.S. Cl. ..... 101/409

[58] Field of Search ..... 101/409, 410, 413, 415

[56] References Cited

U.S. PATENT DOCUMENTS 3,682,472 8/1972 Barthel ..... 101/409

3,910,569 10/1975 Ericsson ..... 101/410

FOREIGN PATENT DOCUMENTS 3000576 7/1981 Fed. Rep. of Germany ..... 101/409

2830432 4/1982 Fed. Rep. of Germany ..... 101/409

*Primary Examiner*—E. H. Eickholt

*Attorney, Agent, or Firm*—Peter K. Kontler

[57] ABSTRACT

A printing plate is secured to the printing cylinder of an offset printing machine by clamping bars which are installed in the cylinder channel and carry gripping strips serving to hold the edges of the printing plate. The front edge of the printing plate is provided with cutouts for the tips of feelers forming part of electronic measuring devices which are mounted on the guide strips of the printing cylinder. The cutouts have a fixed relationship relative to images on the printing plate. The clamping bar for the front edge of the printing plate is adjustable with reference to the printing plate by tightening screws until the measuring devices indicate that the front edge is in zero position. The measuring devices thereupon indicate any deviations of the position of the printing plate from zero position with reference to the printing cylinder.

7 Claims, 7 Drawing Figures

FIG. 1
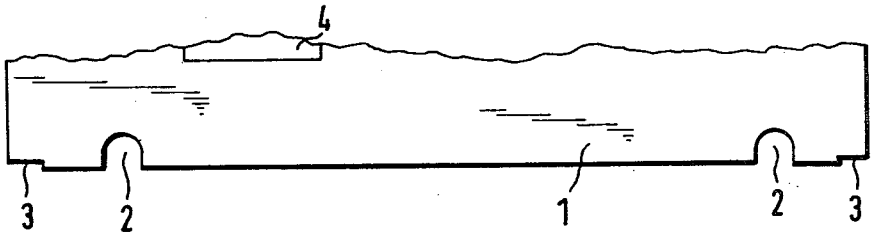
FIG. 2
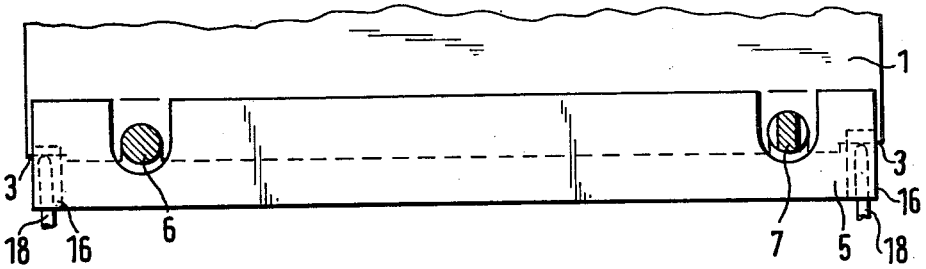
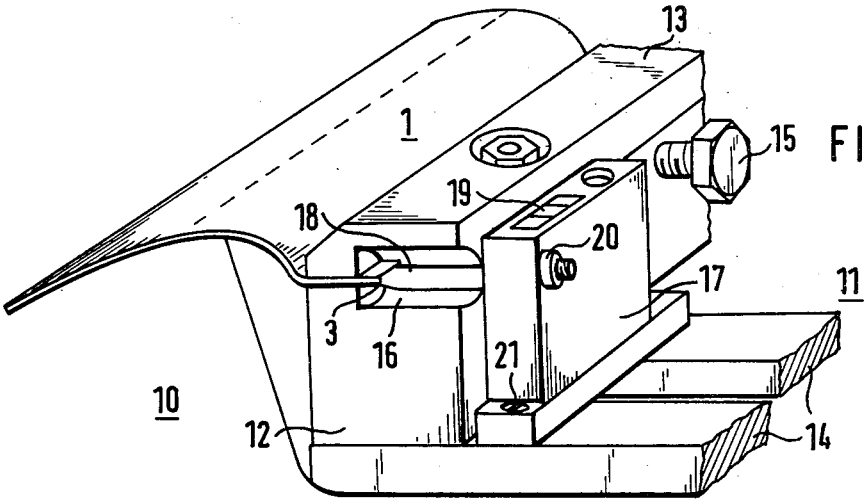
FIG. 3

DEVICE FOR CONTROLLING THE CLAMPING OF PRINTING PLATES IN CORRECT REGISTER ON THE PLATE CYLINDER OF AN OFFSET PRINTING MACHINE

The invention relates to a device for controlling the clamping of printing plates in correct register on the plate cylinder of an offset printing machine by means of clamping bars which are arranged in the cylinder channel and on which one end in each case of a printing plate can be held by gripping strips and which are movable in the peripheral direction of the cylinder by means of tightening screws which are screwed into the clamping bars and are supported on either wall of the channel, in which the displacement of the clamping bar holding the front edge of the plate is controllable with respect to the plate cylinder by means of electrical indicator arrangements having a feeler extending in the direction of movement.

Such a device is illustrated and described in German Offenlegungsschrift No. 30 00 576. In this device, the adjustment of the printing plate relative to the plate cylinder is achieved in such a way that, by means of registration cut-outs which are known per se, the printing plate is set on registration bolts in the clamping bar and is clamped on the clamping bar by means of the gripping strip and then the clamping bar is adjusted relative to the front wall of the plate cylinder with the aid of the tightening screws and the adjustment device. Thus, the known device is a system based on the clamping bar, that is to say that the adjustment device controls the position of the clamping bar but does not directly control the position of the printing plate so that as a result it may not be noticed if the printing plate is not exactly aligned relative to the registration bolts. It can therefore happen that the device indicates the "zero position" of the clamping bar which holds the front edge of the plate but that the actual zero position of the printing plate is not reproduced on the plate cylinder and thus register differences occur during printing.

The object of the invention, therefore, is to achieve an exact indication of the position of the printing plate based on the plate cylinder with the aid of an electrical indicator arrangement. This object is achieved with the characterising features of the main claim.

Because the front edge of the printing plate is directly sensed with the aid of the feelers of the indicator arrangements which are themselves mounted in the channel of the plate cylinder, a faulty alignment of the registration cut-outs on the printing plate relative to the registration bolts in the clamping bar does not have the effect of falsifying the position since the clamping bar is taken out of the measuring sequence. When the printer clamps the printing plate on, he will turn the tightening screws in the clamping bar until the indicator arrangement gives the exact zero position of the printing plate on the plate cylinder. Since the sensing tip of the feeler lines up with a specific edge region of the printing plate and there is a fixed relationship between this specific edge region and the positions of the print image on the printing plate because the mounting sheets are cut with the same registration punch as the printing plates, provision is made for the necessary accuracy of register for multicolour printing.

The alignment of the printing plate in the clamping bars and the alignment of the mounting sheets relative to the printing plates in the production of plates does not have to be achieved with the aid of registration cut-outs which are known per se for example from U.S. Pat. No. 3,835,778, but any other conventional alignment system can be used so long as there is a fixed relationship between the specific regions of the front edge of the printing plate with which the sensing tip of the feeler lines up and the positions of the print images on the printing plate.

However, if the above-mentioned registration cut-outs are used on the printing plate, it is advantageous to carry out one common punching operation to produce the registration cut-outs on the front edge of the printing plate as well as further cut edges as specific edge regions for the sensing tips to touch.

If the space at the side of the clamping bars in the cylinder channel does not permit the feelers to touch regions of the front edge of the printing plate on either side of the clamping bar, then the clamping bar and the gripping strip can have cut-outs, level with the clamped front edge of the printing plate and at the location of the specific edge region, in which the feelers engage and touch the specific edge regions. Usually one feeler with an associated position control device is arranged near each of the two ends of the cylinder channel.

In the arrangement of a printing machine with the device according to the invention the control devices with the feeler are mounted on guide strips in the cylinder channel on which the clamping bars are also supported. The position of the feeler can be adjusted roughly with the aid of mechanical preadjustment means and is then preadjusted to the zero position, and accurate fine adjustment can be achieved electronically if, as is preferred, the longitudinal displacement of the feeler is determined by means of a capacitively operating length measuring arrangement, as described in German Pat. No. 28 30 432. This exact zero position is set after the first printing using the device according to the invention.

It is advantageous if the indicator arrangement is constructed as a measuring device which indicates variations on either side of the zero position, that is to say when the adjusting movement of the feeler relative to the zero movement is not established but its extent can be read off. This can be easily achieved with the above-mentioned capacitive length measuring device according to German Pat. No. 28 30 432 in which an accurate digital indication of the deviation is obtained. Furthermore, the measuring device is battery-powered so that no current supply is required to the device which is revolving rapidly with the plate cylinder. The indication of the adjustment distance of the feeler relative to its zero position permits the printer to make a voluntary adjustment of the printing plate on the plate cylinder if he finds a register difference of one print colour in the proof copy. The exact zero position of the feeler can then be very easily reset for the next printing operation.

The invention will be described below in greater detail with reference to the drawings, in which:

FIG. 1 shows the front edge of an offset printing plate;

FIG. 2 shows the front edge of the printing plate held in the front clamping bar with the set screws and tightening screws omitted;

FIG. 3 shows an enlarged view of a cutaway portion of one side of the cylinder channel with the front clamping bar and the control device according to the invention;

Figure 4:
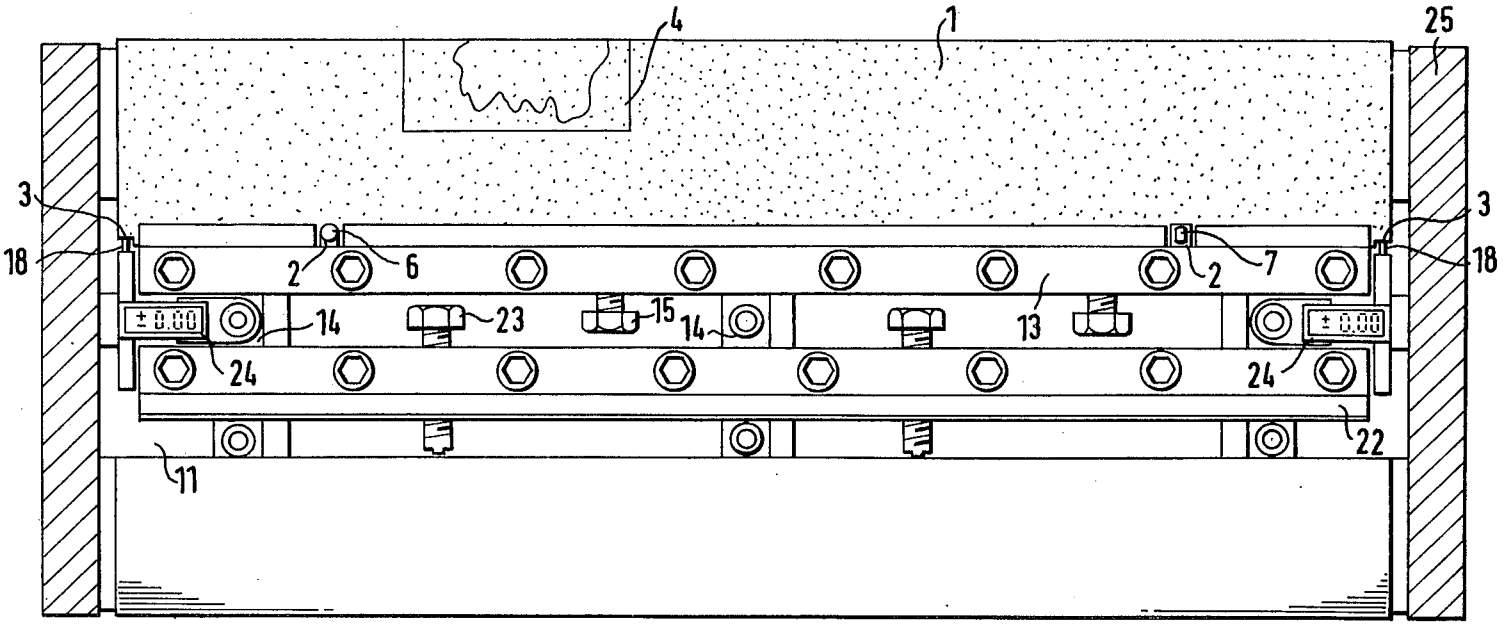
FIG. 4 shows a plan view of the plate cylinder at the location of the cylinder channel, with only the front edge of a clamped printing plate being shown.

FIG. 1 shows the front edge of a printing plate 1 in which a registration punch has been used to produce registration cut-outs 2 and edge cut-outs 3 in the same punching operation with which feelers of the control device according to the invention line up, as will be explained below. As is also known, during the preparation of the plate 1 for printing, images 4 are applied to it which have a fixed spatial relationship to the registration cut-outs 2 and thus also to the edge cut-outs 3.

FIG. 2 shows the printing plate 1 in its clamped position in a clamping bar 5 in which there are registration bolts 6, 7 against which the plate 1 with its registration cut-outs 2 is pushed before the plate is clamped in the clamping bar 5. In the clamping bar 5, there are lateral recesses 16 which are of such a depth that the edge cut-outs 3 on the front edge of the plate 1 are free so that the tips of feelers 18 can line up there and thus the position of the printing plate 1 relative to a feeler guide can be established.

FIG. 3 shows a cutaway portion of a plate cylinder 10 in which guide strips 14 for the clamping bar 12 with its gripping strip 13 for the registration system are fixed in a conventional manner so that they are accurately positioned on the bottom of the cylinder channel 11. The front edge of a printing plate 1 is clamped in the clamping bar in the same way as is illustrated in plan view in FIG. 2, and the perspective view of this FIG. 3 shows how the feeler 18 enters the recess 16 of the clamping bar 12 and the gripping strip 13 and rests on the edge cut-out 3.

The clamping bar 12 can be moved by tightening screws 15 which rest on the front wall of the cylinder channel, so that the position of the printing plate 1 can be adjusted relative to the guide strips 14. In order to be able to establish accurate control of the position of the printing plate 1 on the plate cylinder 10 and thus also relative to th guide strips 14, the feeler 18 is guided in a measuring device 17, and inside the measuring device 17 it can be connected for example to the adjustment member of a capacitive length measuring device known from German Pat. No. 28 30 432 whilst the other elements of this length measuring device are fixed in the housing of the measuring device 17. The whole measuring device 17 is screwed firmly onto the guide strips 14 with screws 21 when the plate cylinder 10 is equipped with the registration system according to the invention.

The feeler 18 is capable of determining changes in the position of the edge cut-outs 3 with the accuracy necessary for printing and indicating such changes in position on a digital indicator 19 with reference to a zero position which is fixed on setting up of the machine. For setting up of the machine, the measuring device 17 permits a rough mechanical adjustment by means of a set screw designated by 20, whilst after the exact zero position of the feeler 18 has been determined, the counter 19 of the measuring device can be finely adjusted electronically, for example by resetting to zero.

The plan view of FIG. 4 shows the whole plate cylinder with the cylinder channel 11 in which are located the front clamping bar with the gripping strip 13 and a rear clamping bar 22, which can be guided on the guide strips 14 and adjusted by means of tightening screws 15, 23. The front edge of the printing plate 1 is screwed into the front clamping bar and thus its registration cut-outs 2 are pushed onto the registration bolts 6, 7. In the case of the embodiment illustrated here, the side edges of the printing plate 1 project laterally beyond the clamping bars so that the cut-outs with the edge cut-outs 3 are free adjacent to the clamping bars and the feelers of the two measuring devices 24 which are arranged at both ends of the cylinder channel 11 and are each screwed onto one guide strip 14 can engage unhindered on the edge cut-outs 3.

The advantage of this construction resides principally in the fact that a particularly large space is available in the longitudinal direction of the capacitive length measuring device connected to the feeler 18. For further stabilisation, the measuring device 24 can be supported on Schmitz rings 25 of the plate cylinder.

The illustrations of FIGS. 3 and 4 show clearly that the position of a printing plate 1 placed on the plate cylinder relative to the plate cylinder 10 itself is determined by the feelers 18 of the measuring devices 17 or 24 which are firmly screwed to the registration system according to the invention when the printing machine is set up and are roughly and finely adjusted to the zero position, irrespective of any errors in clamping the front end of the plate with its registration cut-outs 2 in the front clamping bar 5 or 12, 13.

Figure 5:
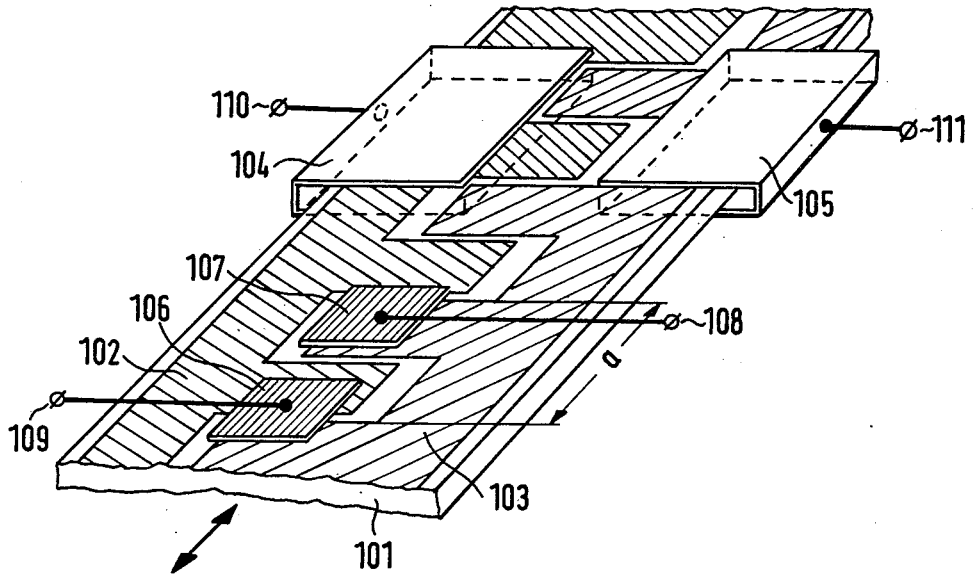
FIG. 5 shows the base member of the digital measuring arrangement with the connecting and disconnecting electrodes.

As can be seen in FIG. 5, the digital measuring arrangement is straight and comprises an electrically non-conductive base member 101 for two electrically conductive conductor strips 102 and 103 which are provided with comb-like projections and constitute the scale. The conductor strips extend in the direction of transport and are connected to the connecting electrodes 104 and 105 which receive a-c potential by way of terminals 110 and 111. Two disconnecting electrodes 106 and 107 with terminals 109 and 108 are disposed at a short distance from and in plano parallel relation to the conductor strips. The disconnecting electrodes are slightly wider than the projections of a conductor strip. The projections of the conductor strips 102 and 103 and the disconnecting electrodes 106 and 107 constitute disconnecting capacitors $C_{26}$ and $C_{36}$ *resp.* $C_{27}$ and $C_{37}$. The distance between a lateral edge of a projection of a conductor strip and the corresponding lateral edge of the next projection of the same conductor strip is indicated at a. The distance between the center of the area of the disconnecting electrode 106 and that of the disconnecting electrode 107 is less than a, in the illustrated embodiment $\frac{3}{4}a$. The disconnecting electrodes cannot be shifted relative to one another but they are mounted for movement relative to the base member 101.

Figure 6:
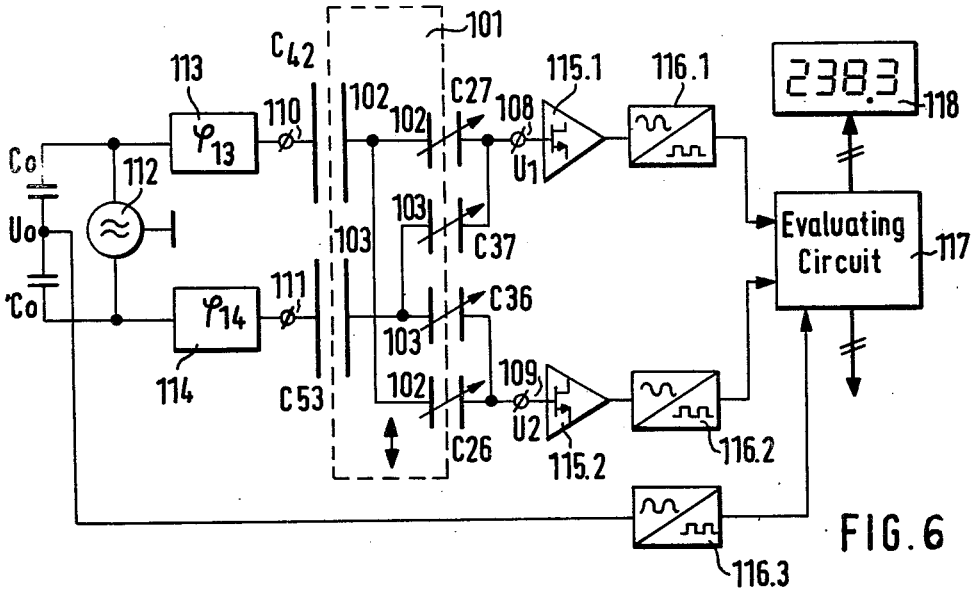
FIG. 6 illustrates the circuit diagram of the measuring arrangement.

The electric circuit diagram is shown in FIG. 6. An oscillator 112 generates two phase-shifted (preferably by 90°) a-c potentials which are applied to two phase shifters 113, 114 whose output potential is applied to the terminals 110 and 111. The two phase-shifted a-c potentials are further applied to two capacitors $C_o$ to provide a reference voltage $U_o$.

The concuctor strips 102 and 103 and the connecting electrodes 104 and 105 constitute connecting capacitors $C_{42}$ and $C_{53}$. Furthermore, the conductor strips 102 and 103 constitute with the disconnecting electrodes disconnecting capacitors $C_{26}$, $C_{27}$, $C_{36}$, $C_{37}$. This is due to the fact that the two disconnecting electrodes do not fully overlie two successive projections of the conductor strips 102 and 103 but, as a rule, are disposed only in part above such projections. FIG. 5 illustrates, as an exceptional case, the possibility that the disconnecting electrode 107 fully overlies a projection whereas the disconnecting electrode 106 overlies one-half of each of two neighboring projections. The evaluation which will be described below is made possible in view of the selected distance relationships.

Figure 7:
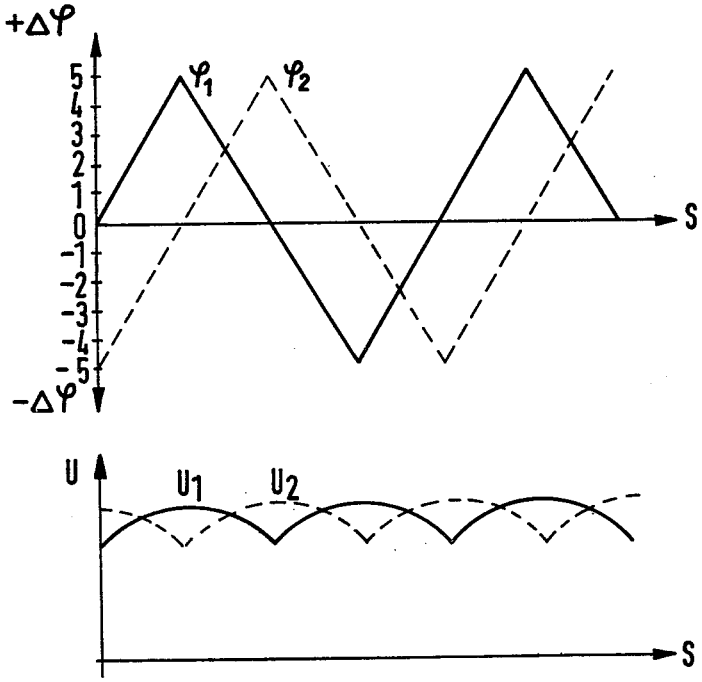
FIG. 7 illustrates the phase and amplitude progress of potentials at the two disconnecting electrodes as a function of the distance s of the disconnecting electrodes from the base member.

Depending upon the relative positions of the disconnecting electrodes 106 and 107 above the projections, the capacitors $C_{26}$, $C_{36}$ and $C_{27}$, $C_{37}$ exhibit different capacity values and the progress of voltages $U_2$ and $U_1$, as regards their amplitude and their additional phase shift $\Delta\phi_2$ and $\Delta\phi_1$, at their output terminals 109 and 108 is as shown in FIG. 7. Thus, the amplitude and the phase shift fluctuate between a maximum and a minimum value in response to relative shifting between the base member 101 and the disconnecting electrodes 106 and 107. As can be seen in FIG. 7, the selected phase shift of voltages at the outputs of the phase shifters 113 and 114 entails minor fluctuations of amplitude but the fluctuations of phase shift are still sufficiently pronounced. This is the reason why the measuring arrangement is not appreciably affected by tilting of the disconnecting electrodes 106 and 107 with reference to the base member 101.

The voltages $U_1$ and $U_2$ are amplified by high-resistance amplifiers 115.1 and 115.2 to be thereupon converted into square signals by pulse shapers 116.1 and 116.2. The square signals are transmitted to an electronic evaluating circuit 117. The evaluating circuit ascertains the difference between the phases of the two amplified measuring voltages and the reference voltage $U_o$. If the phase difference between $U_o$ and $U_1$ equals zero, the contents of a counter are increased by one step or reduced by a step, depending upon the phase difference between the voltages $U_o$ and $U_2$. Thus, the direction of movement of the scale is ascertained with assistance from the voltage $U_2$. In order to achieve an even more precise resolution of the measured value, the region between the maximum values of the phase angle differences $+\Delta\phi_{max}$ and $-\Delta\phi_{max}$ is subdivided into ten stages which correspond to the nonius of a mechanical measuring instrument, e.g., a slide rule. In a manner known per se, resort is made to an additional oscillator having a substantially higher frequency to ascertain the interval between the rising flank of the measuring voltage $U_1$ and the rising flank of the reference voltage $U_o$ by counting and to set the relationship to the duration of periods of the reference voltage. The results of measurement with the zero phase counter and the phase difference counter in the evaluating circuit 117 are indicated by the display 118. It is also possible to transmit the results of measurements to data processing equipment.

A particular advantage of the described arrangement and of the corresponding measuring method is that the phase difference, which is used for evaluation, is independent from the absolute value of capacities of the capacitors $C_{26}$ and $C_{36}$ resp. $C_{27}$ and $C_{37}$ as well as from the amplitude of the feed voltages and is determined exclusively by the ratio of the capacities. Therefore, a change of the distance between the disconnecting electrodes and the conductor strips of the digital scale initially does not influence the result of the measurement. Therefore, the requirements concerning the accuracy of mechanical guidance in the measuring range are relatively low. Even larger deviations are acceptable in the region of the connecting electrodes since they constitute differential capacitors and, therefore, the amplitude of the supplied a-c voltage remains sufficiently constant; even in the event of changes in position. The accuracy of measurement is determined by the ratio of frequencies of the two oscillators.

We claim:

1. Device for controlling the clamping of printing plates in correct register on the plate cylinder of an offset printing machine by means of clamping bars which are arranged in the cylinder channel and on which one end in each case of a printing plate can be held by gripping strips and which are movable in the peripheral direction of the cylinder by means of tightening screws which are screwed into the clamping bars and are supported on either wall of the channel, in which the displacement of the clamping bar holding the front edge of the plate is controllable with respect to the plate cylinder by means of electrical indicator arrangements having a feeler extending in the direction of movement, characterised in that the electrical indicator arrangements (17, 24) with the feeler (18) are fastened to the plate cylinder (10) in the cylinder channel (11), the sensing tip of the feeler (18) lines up with a specific region of the front edge of the printing plate (1), and the positions of the images (4) on the printing plate (1) have a fixed relationship to the specific region (3) of the front edge of the printing plate.

2. Device as claimed in claim 1 with registration cut-outs which are known per se on the printing plate, characterised in that the specific region (3) has a fixed spatial relationship to the registration cut-outs (2).

3. Device as claimed in claim 2, characterised in that the specific region (3) is an edge cut-out and is produced with the registration cut-outs (2) in one common punching operation.

4. Device as claimed in claim 1, 2 or 3, characterised in that the clamping bar (12) and the gripping strip (13) have recesses (16) in which the feelers (18) engage and touch the specific regions (3) level with the clamped front edge of the printing plate (1) and at the location of the specific regions (3).

5. Device as claimed in claim 1, characterised in that the feeler (18) has mechanical preadjustment means (20) and an electronic fine adjustment arrangement for the exact zero position.

6. Device as claimed in claim 1, characterised in that the indicator arrangement is constructed as a measuring device which indicates deviations on either side of the zero position.

7. Device as claimed in claim 6, characterised in that the measuring device is battery-powered and has a digital indicator (19).

* * * * *